United States Patent [19]

Wallin

[11] Patent Number: 5,022,722

[45] Date of Patent: Jun. 11, 1991

[54] PORTABLE CLOSET

[76] Inventor: Maynard A. Wallin, 2399 E. 14th Sp 147, San Leandro, Calif. 94577

[21] Appl. No.: 390,072

[22] Filed: Sep. 15, 1989

[51] Int. Cl.[5] ..... A47B 61/00

[52] U.S. Cl. ..... 312/309; 312/324; 211/1.3; 211/104

[58] Field of Search ..... 211/104, 1.3, 13, 97, 211/100, 168, 171, 195; 312/292, 321.5, 324, 309, 327

[56] References Cited

U.S. PATENT DOCUMENTS 1,278,790 9/1918 Thunell ..... 211/1.3 X 2,434,891 1/1948 Swanson ..... 211/1.3 X 2,778,705 1/1957 Barkes ..... 211/1.3 X 4,029,211 6/1977 Marshall ..... 211/104

*Primary Examiner*—Sarah A. Lechok

*Attorney, Agent, or Firm*—Linval B. Castle

[57] ABSTRACT

A portable clothes closet designed to provide extra storage in small homes or recreation vehicles is tall, narrow and thin so that it could fit behind a door. The closet is fitted with a pivoting trouser hanger that is held up in a horizontal position by the open door, a pivoted shirt hanger for about a dozen shirts and both tie and belt racks.

5 Claims, 2 Drawing Sheets

PORTABLE CLOSET

BACKGROUND OF THE INVENTION

This invention relates generally to storage facilities and particularly to a novel, portable, clothes hanging closet, suitably small for placing behind a door and particularly valuable for use in recreation vehicles.

Hanging space of shirts, trousers or the like is often scarce and clothing of this type is often found on a wire hanger hanging over a door or shower curtain pole. In close living quarters such as found in many non-permanent residences such as recreation vehicles, space for more than a few "weekend" clothes does not exist and if one must use such a vehicle for more permanent living, there is no adequate clothes hanging space.

The closet to be described is sufficiently thin to fit behind a door or to position in a recreation vehicle without consuming excessive space, and yet it can hold two dozen shirts on hangers, a dozen slacks, and nearly a dozen ties and belts. Unloaded, it is light in weight and its 28 inch width permits it to be easily moved when desired.

DESCRIPTION OF THE DRAWINGS

In the drawings which illustrate the preferred embodiment of the invention.

BRIEF DESCRIPTION OF THE PREFERRED EMBODIMENT

Figure 1:
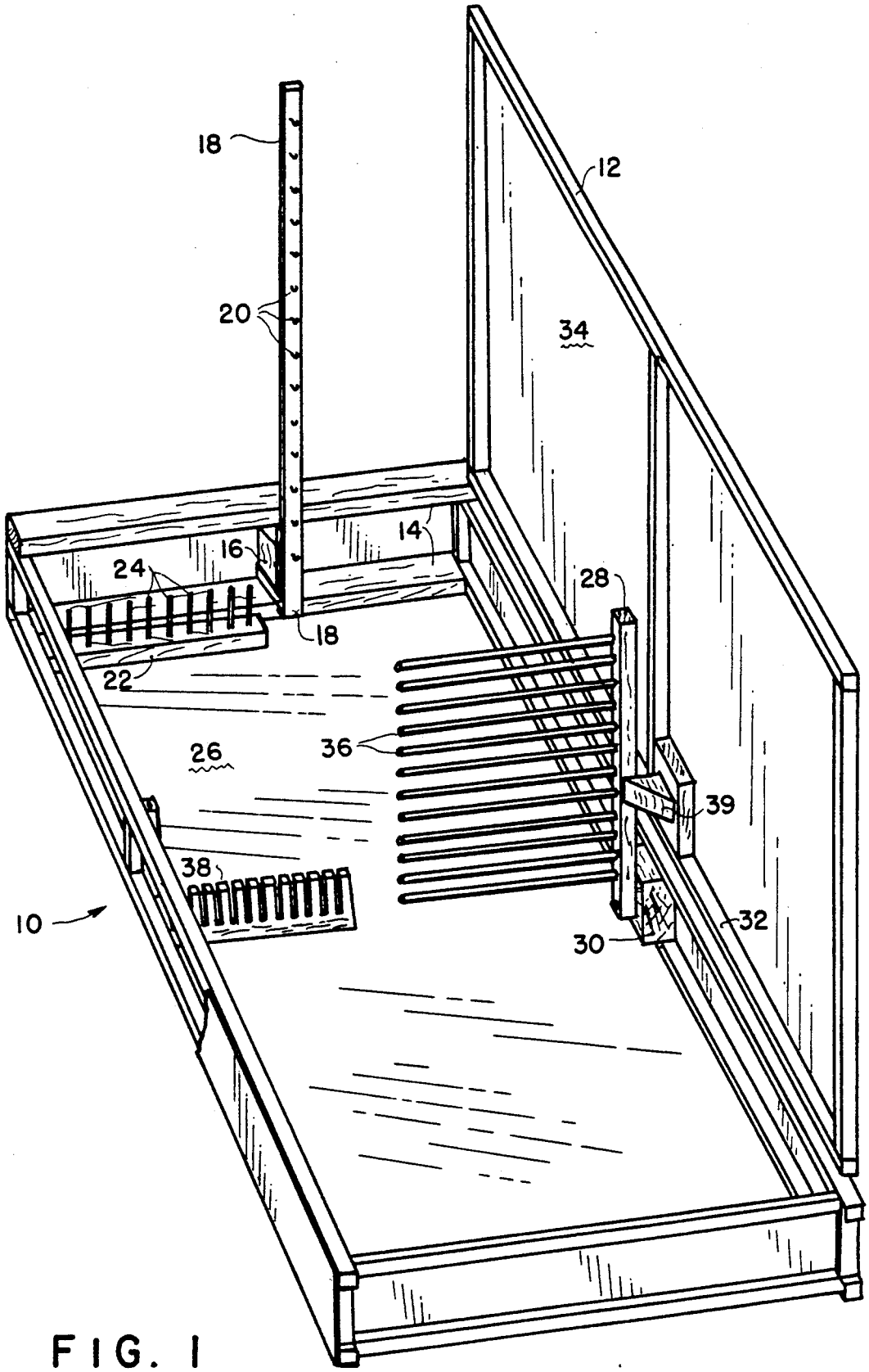
FIG. 1 is a perspective drawing of the closet with the door open and the trouser and shirt hangers extended.

Illustrated in FIG. 1 is the closet 10 with the door 12 open to display the various components therein. The closet and its door are formed of a wood frame covered with light plywood and preferably has the overall dimensions of 72 to a maximum of 84 inches in height, 26 to 30 inches wide, and 6 to 10 inches deep. Because of its small depth and relatively large height, it would be advisable to secure the closet to a wall to prevent its falling, particularly when used in a moving vehicle.

Figure 2:
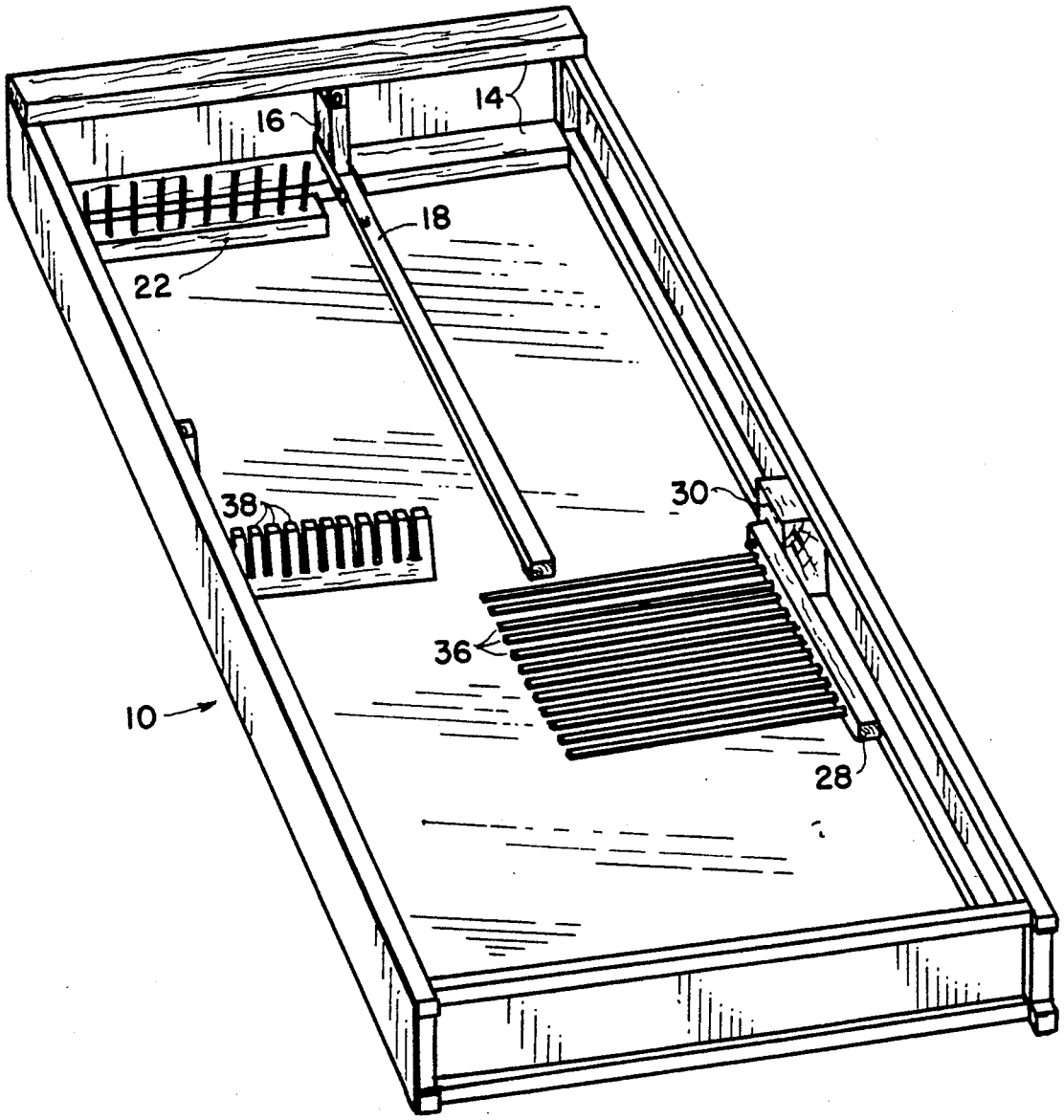
FIG. 2 is a perspective drawing of the closet with the door removed to view the trouser and shirt hangers retracted.

A distance of approximately a third the closet width across the top frame 14 from the door edge of the closet is a wooden member 16 attached between the top frame members. This member 16 carries a metal strap on each side that has a pivot hole at its exterior end and a bolt that pivots a wooden shirt rack 18 about forty inches in length and having about fifteen large equally spaced shirt hanger hooks 20 screwed in along its length. The shirt rack 18 is locked in the horizontal position, as shown, by a conventional touch latch mounted on the top of the rack 18 and the bottom of the wooden member 16, as shown in FIG. 2. To release the rack from the touch latch, it is only necessary to lift the end of the rack.

A stationary tie rack 22 formed of a rectangular board about fourteen inches in length with a dozen or more hardwood dowels 24 equally spaced along its length is secured in the top of the closet and against its rear wall 26. Most of the ties on the rack are visible when the closet door is open; however, a few on the right end of the rack will be partially hidden by the shirts.

A wooden arm 28 about nineteen inches in length is pivoted at one end to a block 30 in the closet frame in the sidewall adjacent the hinged door edge 32 so that the arm may pivot outward when the door 34 is opened. The arm 28 support about a dozen half-inch hardwood dowels 36, about fourteen inches in length, which are mounted horizontally and evenly spaced along the arm to function as trouser hangers. Trousers may easily be added or removed from a dowel 36 when the arm 28 is pivoted horizontally outward and are locked in place when the arm is pivoted downward and the door is closed. To hold the arm 28 in a horizontal position while a selection is being made a bracket 39 is attached to the inner surface of the door 34 so that the raised arm 28 may rest upon it. The arm 28 must then be removed to confine together all the trousers on the arm 28 before the door is closed as shown in FIG. 2.

The remaining space in the lower section of the closet and on the side opposite the trouser hanger may be used for belt storage. A wooden "comb" about a foot in length and with about a dozen narrow dado cuts across it provides a convenient belt rack 38 when horizontally mounted on the ¼ inch plywood rear wall panel 26 of the closet opposite the trouser hanger.

The entire closet is enclosed to seal it against dust and dirt. As mentioned above, the rear wall 26 is preferably ¼ in plywood. For strength, the top and bottom panels should preferably be ¾ inch plywood; the sides and door panel 34, being framed, need be only ⅛ inch plywood.

I claim:

1. A temporary closet for storage of clothing in a non-permanent residence, said closet including:

an enclosed cabinet having a top, a bottom, first and second sides, and a rear panel, said cabinet having a maximum height of 84 inches, a maximum width of thirty inches, and a maximum front-to-back thickness of ten inches, said cabinet having a hinged panel door enclosing the front of said cabinet and swinging open from the first side of said cabinet;

a bracket attached to the interior surface of said door at a location at the approximate center of said door; and a trouser rack including an arm pivotally coupled to the first interior side of said cabinet at a location at the approximate center of said first side, said arm engaging the top of said bracket when said door is open for holding said trouser rack in a substantially horizontal position.

2. The closet claimed in claim 1 wherein said trouser rack arm has a plurality of horizontal dowels inserted therein for supporting a plurality of trousers.

3. The closet claimed in claim 1 further including a shirt rack comprising an arm pivoted at one end to the interior top of said cabinet for rotation between the vertical and horizontal, said shirt rack arm containing a plurality of hanger supporting hooks and having means for temporarily securing said arm in a horizontal position.

4. The closet claimed in claim 1 further including a necktie rack comprising an arm containing a plurality of in-line dowels, said arm being horizontally located at the interior top of said cabinet adjacent the second side thereof.

5. The closet claimed in claim 1 further including a belt rack comprising an arm containing a plurality of vertical slots for hanging belts, said belt rack being horizontally mounted on the rear panel of said cabinet adjacent said second side thereof.

* * * * *